US008024908B2

(12) United States Patent
Williams

(10) Patent No.: US 8,024,908 B2
(45) Date of Patent: Sep. 27, 2011

(54) PULTRUDED UTILITY STRUCTURES

(76) Inventor: Donald S. Williams, Chicago, IL (US)

( * ) Notice: Subject to any disclaimer, the term of this patent is extended or adjusted under 35 U.S.C. 154(b) by 702 days.

(21) Appl. No.: 11/803,977

(22) Filed: May 16, 2007

(65) Prior Publication Data

US 2007/0266670 A1 Nov. 22, 2007

Related U.S. Application Data

(60) Provisional application No. 60/801,856, filed on May 18, 2006.

(51) Int. Cl.
*E04H 12/02* (2006.01)
*E04C 3/34* (2006.01)

(52) U.S. Cl. ..... 52/843; 52/651.02; 52/651.07; 52/852; D25/123; D25/125

(58) Field of Classification Search ..... 52/651.01, 52/651.02, 651.07, 831, 834, 836, 843, 852; D25/123, 125, 129
See application file for complete search history.

(56) References Cited

U.S. PATENT DOCUMENTS

| | | | | | |
|---|---|---|---|---|---|
| 3,813,837 | A | * | 6/1974 | McClain et al. | 52/309.1 |
| 3,987,593 | A | * | 10/1976 | Svensson | 52/98 |
| 4,012,267 | A | | 3/1977 | Klein | |
| 4,103,104 | A | | 7/1978 | Spollen | |
| 4,142,343 | A | * | 3/1979 | Trafton | 248/219.1 |
| 4,194,338 | A | * | 3/1980 | Trafton | 403/305 |
| 4,438,430 | A | | 3/1984 | Young | |
| 4,516,069 | A | | 5/1985 | Schmanski | |
| 4,738,058 | A | * | 4/1988 | Svensson | 52/98 |
| 4,751,804 | A | * | 6/1988 | Cazaly | 52/651.02 |
| 4,803,819 | A | | 2/1989 | Kelsey | |
| 4,812,343 | A | | 3/1989 | Kiekhaefer | |
| 4,941,763 | A | * | 7/1990 | Euteneuer | 403/3 |
| 5,091,036 | A | * | 2/1992 | Taylor | 156/379.6 |
| 5,175,971 | A | | 1/1993 | McCombs | |
| 5,207,850 | A | | 5/1993 | Parekh | |
| 5,212,891 | A | | 5/1993 | Schuermann | |
| 5,222,344 | A | | 6/1993 | Johnson | |
| 5,263,296 | A | * | 11/1993 | Spera | 52/638 |
| D344,351 | S | * | 2/1994 | Stagl | D25/122 |
| 5,354,607 | A | | 10/1994 | Swift | |
| 5,361,855 | A | | 11/1994 | Schuermann | |
| 5,379,566 | A | * | 1/1995 | Schworer | 52/632 |
| 5,457,288 | A | | 10/1995 | Olsson | |

(Continued)

FOREIGN PATENT DOCUMENTS

CA 1 250 757 A1 3/1989

(Continued)

OTHER PUBLICATIONS

Pultrusion Industry Council; Glossary of Terms; Copyright © 2007—Pultrusion Industry Council http://www.cfa-hq.org/pic/products/glossary.htm.*

(Continued)

*Primary Examiner* — Brian Glessner
*Assistant Examiner* — Joseph Sadlon

(57) ABSTRACT

A pultruded utility structure is presented. The pultruded utility structure are pultruded or extruded in a pre-determined shape, in plural colors, is environmentally safe, aesthetic pleasing and resistant to damage from weather, animals, insects and resistant to corrosion. The pultruded utility structure includes utility pole, a lighting pole, a structural support, an architectural design element (interior or exterior), a marine dock element or a fencing element, etc.

17 Claims, 6 Drawing Sheets

U.S. PATENT DOCUMENTS 5,465,929 A 11/1995 Dooley
5,476,627 A 12/1995 Black
D370,273 S * 5/1996 Stagl ..... D25/122
5,513,477 A 5/1996 Farber
5,585,155 A 12/1996 Heikkila
5,650,224 A 7/1997 March
5,658,307 A 8/1997 Exconde
5,658,519 A 8/1997 March
5,704,185 A 1/1998 Lindsay
5,716,686 A 2/1998 Black
5,718,669 A 2/1998 Marble
5,870,877 A 2/1999 Turner
5,890,333 A * 4/1999 Boroviak ..... 52/292
5,899,423 A * 5/1999 Albertini ..... 248/188.8
5,937,521 A 8/1999 March
D415,574 S * 10/1999 Shrira ..... D25/61
5,971,508 A 10/1999 Deimen
5,971,509 A 10/1999 Deimen
5,972,275 A 10/1999 Phelps
5,979,119 A * 11/1999 Trafton ..... 52/40
5,999,677 A 12/1999 Moncisvais
6,007,656 A 12/1999 Heikkila
6,047,514 A 4/2000 Verch
6,087,467 A 7/2000 Marrocco, III
6,106,944 A 8/2000 Heikkila
6,155,017 A 12/2000 Turner
6,174,483 B1 * 1/2001 Brown, Jr. ..... 264/285
D441,877 S * 5/2001 Fortier ..... D25/122
6,357,196 B1 3/2002 McCombs
6,367,215 B1 4/2002 Laing
6,400,873 B1 6/2002 Gimblet
6,453,635 B1 * 9/2002 Turner ..... 52/848
6,484,647 B2 * 11/2002 Lininger, Jr. et al. ..... 108/50.01
6,513,234 B2 2/2003 Wilemon
6,568,072 B2 5/2003 Wilemon
6,627,704 B2 9/2003 Yeager
6,764,057 B2 7/2004 Fanucci
6,808,334 B2 * 10/2004 Nicoletti ..... 403/170
6,812,276 B2 11/2004 Yeager
6,834,469 B2 12/2004 Fingerson
6,897,382 B2 5/2005 Hager
6,993,802 B1 2/2006 Hone
7,063,096 B2 * 6/2006 Stoeckler ..... 135/114
7,086,341 B2 * 8/2006 Peddicord ..... 108/180
7,116,282 B2 * 10/2006 Trankina ..... 52/845
7,127,865 B2 10/2006 Douglas
7,200,973 B2 4/2007 Tunis
7,228,672 B2 * 6/2007 Hayes et al. ..... 52/843
7,578,245 B2 * 8/2009 Loines ..... 108/110
2001/0053820 A1 12/2001 Yeager
2002/0037409 A1 3/2002 Tunis
2002/0073915 A1 6/2002 Howard
2002/0095904 A1 7/2002 Fingerson
2003/0096123 A1 5/2003 Yeager
2004/0026112 A1 2/2004 Goldsworthy
2004/0050579 A1 3/2004 Hager
2004/0050580 A1 3/2004 Hager
2004/0050581 A1 3/2004 Hager
2004/0050584 A1 3/2004 Hager
2004/0065457 A1 4/2004 Hager
2004/0121137 A1 6/2004 Tunis
2004/0134162 A1 7/2004 Douglas
2005/0184206 A1 8/2005 Lepley
2005/0223673 A1 10/2005 Cadwell
2006/0123725 A1 6/2006 Godwin
2006/0150531 A1 7/2006 Cann
2006/0201081 A1 9/2006 Godwin
2006/0254167 A1 11/2006 Antonic
2006/0289189 A1 12/2006 Aisenbrey
2007/0013096 A1 1/2007 Rekret
2007/0107370 A1 5/2007 Douglas
2007/0113958 A1 5/2007 Brown
2007/0113983 A1 5/2007 Brown
2007/0116941 A1 5/2007 Brown
2007/0117921 A1 5/2007 Brown
2007/0209305 A1 9/2007 Douglas
2007/0223993 A1 9/2007 Peterson
2007/0252302 A1 11/2007 Hager
2010/0064630 A1 3/2010 Williams

FOREIGN PATENT DOCUMENTS

DE 295 00 49 U1 8/1995
WO WO 2006/050235 A1 1/2006

OTHER PUBLICATIONS

International Preliminary Report on Patentability PCT/US2007/011,781 dated Nov. 27, 2008.

* cited by examiner

PULTRUDED UTILITY STRUCTURES

CROSS REFERENCES TO RELATED APPLICATIONS

This application claims priority to U.S. Provisional application 60/801,856 filed May 18, 2006, the contents of which are incorporated by referenced.

FIELD OF INVENTION

This application relates to plutrued and extruded structures. More specifically, it relates to a pultrued and extruded utility structures.

BACKGROUND OF THE INVENTION

Most utility poles used today made of wood. Utility poles are divided into ten classes, from 1 to 10. The classes' definition specifies a minimum circumference that depends on the species of tree and the length of the pole. This circumference is measured 6 feet from the butt of the pole. There is also a minimum top circumference that is the same for all species and lengths.

For example, a class 1 pole has a minimum top circumference of 27 inches. If it is 25 feet long and cedar (most utility poles are cedar), the circumference measured 6 feet from the bottom must be at least 43.5 inches.

The higher the class number, the skinnier the pole. Pole lengths start at 16 feet and increase by 2-foot steps to 22 feet, then by fives from 25 feet to 90 feet. A 90-foot class 1 western red cedar pole weighs about 6,600 pounds. A 16-foot pole weighs only about 700.

All utility poles used are pressure treated to preserve the wooden utility poles from the weather, insects and other types of attacks and decay. Utility poles are treated with a number of toxic chemicals including pentachlorphenol, chromated copper arsenate, creosote, copper azole and others.

Pentachlorophenol (Penta) is widely-used wood preservative that is normally dissolved in a petroleum carrier. It is the most commonly used preservative system utilized by North American utilities.

Chromated Copper Arsenate (CCA) is water-borne treatment that offers a wide range of advantages for treated lumber, timber and poles; clean; odorless; paintable. For poles, its use is limited to southern yellow pine, pinus sylvestris, and western red cedar.

Creosote is an oil-based wood preservative blended from the distillation of coal tar and comprised of more than 200 major constituents. Used in industrial applications, such as railroad ties, piling (both salt water and fresh water), and for utility poles.

Copper Azole (CA-B) is a water-borne copper based wood preservative with an organic co-biocide (Tebuconazol). Similar in color, to CCA-C, odorless, clean, paintable or stainable. Copper Azole is approved by the American Wood Preservers Association for use on Western Red Cedar and Southern Yellow Pine utility poles.

There are several problems associated with wooden utility poles. One problem is that utility poles are heavy and bulky and hard to move and install. Another problem is that wooden utility poles are treated with chemicals that are harmful to the environment, and poisonous (e.g. arsenic, etc.) to humans and animals and have been shown in some instance to cause cancers. Another problem is that even with pressure treating the wood, wooden utility poles have to be replaced about every ten years. Another problem is that wooden utility poles are not aesthetically pleasing to look and are typically all a brown or black color.

There have been attempts to solve some of these problems. For example, U.S. Pat. No. 7,159,370 that issued to Oliphant, et al. entitled "Modular fiberglass reinforced polymer structural pole system" teaches "This invention is a modular pole assembly comprised of corner pieces and panel members. Panel members are slidably engaged to the corner pieces and are retained in a direction normal to the engagement direction by a track in each slot that nests within a groove in each panel member. corner pieces may include multiple slots along each side, allowing for multiple layers of panel members along each side, thereby increasing strength and allowing an insulative and structural fill material to be added between panel member layers. The height of the modular pole may be increased by inserting splicing posts between consecutive, adjacent corner members and inserting splicing pieces between co-planar adjacent panel members. The modular nature of the pole assembly provides for simple packaging and shipment of the various components and easy assembly at or near the installation location."

U.S. Pat. No. 6,453,635 that issued to Turner entitled "Composite utility poles and methods of manufacture" teaches "Composite utility pole structures and methods of manufacture using a pultrusion process. The poles may be N sided, with longitudinal pre-stressed rovings in each corner. The inner periphery of the poles may have flat regions centered between the outside corners, with the flat regions joined by circular arcs in the corner regions. Various pole structures and methods of manufacture are described, including curved poles and poles having walls that are tapered in thickness and structure."

U.S. Pat. No. 6,357,196 that issued to McCombs entitled "Pultruded utility pole" teaches "A hollow fiberglass utility pole includes a pair of segments that are a fiberglass sheet that has a semicircular cross-section. The segments have first and second longitudinal edges with male and female couplers respective shapes that have a complimentary relationship to each other for mechanical engagement thereof. The fiberglass pole is assembled by engaging the first longitudinal edge of one segment with the second longitudinal edge of the other segment at an installation site. The fiberglass pole may be used as a sheath to encase an existing wooden pole."

U.S. Pat. No. 5,311,713 that issued to Goodrich entitled Electric and telephone pole ground protector teaches "A device and method for protecting the end of a wooden utility pole set in the ground. A split cylindrical casing is provided which can be placed around the lower end of a wooden utility pole just before it is installed in the ground. The casing comprises an elongate, relatively thin cylindrical member having one closed end and being split into two sections connected together along the side thereof. The connection acts as a hinge. The edges of the casing where it is split are provided with a fastener, one part of the fastener being disposed along the edge of one part of the casing and another part of the fastener being disposed along the edge of the other part of the casing. When the cylindrical casing is closed, the edge of one part overlaps the edge of the other part so that the respective parts of the fasteners fit matingly together. Preferably, the fastener extends the entire length of the casing and entirely across the bottom end thereof. Preferably, the casing is made of high grade plastic."

U.S. Pat. No. 5,175,971 that issued to Maccomb entitled 'Utility power pole system" teaches "A utility power pole system comprises a pultruded hollow primary pole having an external hexogonal cross section and a number of longitudinal exterior grooves along its length. The hollow primary pole also has an internal hexogonal cross section rotated 30.degree. relative to the external hexagonal cross section. One or more pultruded hollow liners are provided which are also hexagonal in cross section and which may be internally or externally concentric with the primary pole. These liners vary in length to achieve an effective structural taper to the power pole system. The insertion of a tapered liner in the lower portion of the utility pole results in a utility pole having the effective load bearing capability of a tapered utility pole. By using a plurality of overlapping liners of varying lengths, an effective taper can be provided to the utility pole. The longitudinal grooves in the outer surface of the primary pole provide a means for climbing for a utility lineman and a means for attaching accessory attachment devices such as cross arms, stiffening members, conductor supports and for interconnection with other structural elements in a more extensive system. The rounded edges of each longitudinal groove are directed inwardly so as to retain devices in the groove which conform to the cross section of the groove. Cross arms attached to the utility pole may also employ similar longitudinal grooves to facilitate interconnection with existing utility hardware or other components."

U.S. Pat. No. 4,803,819 that issued to Kelsey entitled "Utility pole and attachments formed by pultrusion of dielectric insulating plastic, such as glass fiber reinforced resin" teaches "a utility pole and attachments formed by pultrusion of dielectric insulating plastic, such as glass fiber reinforced resin."

However, none of these solutions overcome all of the problems with utility poles and utility structures. Thus, it would be desirable to solve some of the problems associated with utility poles and utility structures.

SUMMARY OF THE INVENTION

In accordance with preferred embodiments of the invention, some of the problems associated with utility poles are overcome.

A pultruded utility structure is presented. The pultruded utility structure are pultruded or extruded in a pre-determined shape, plural colors, is environmentally safe, aesthetic pleasing and resistant to damage from weather, animals, insects and resistant to corrosion. The pultruded utility structure includes utility pole, a lighting pole, a structural support, an architectural design element (interior or exterior), a marine dock element or a fencing element, etc.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Exturded Utility Structures

"Extrusion" is a manufacturing process where a material is pushed and/or drawn through a die to create long objects of a fixed cross-section. Hollow sections are usually extruded by placing a pin or mandrel in the die. Extrusion may be continuous (e.g., producing indefinitely long material) or semi-continuous (e.g., repeatedly producing many shorter pieces). Some extruded materials are hot drawn and others may be cold drawn.

The feedstock may be forced through the die by various methods: by an auger, which can be single or twin screw, powered by an electric motor; by a ram, driven by hydraulic pressure, oil pressure or in other specialized processes such as rollers inside a perforated drum for the production of many simultaneous streams of material.

Plastic extrusion commonly uses plastic chips, which are heated and extruded in the liquid state, then cooled and solidified as it passes through the die. In some cases (such as fiber reinforced tubes) the extrudate is pulled through a very long die, in a process called "pultrusion."

Figure 1:
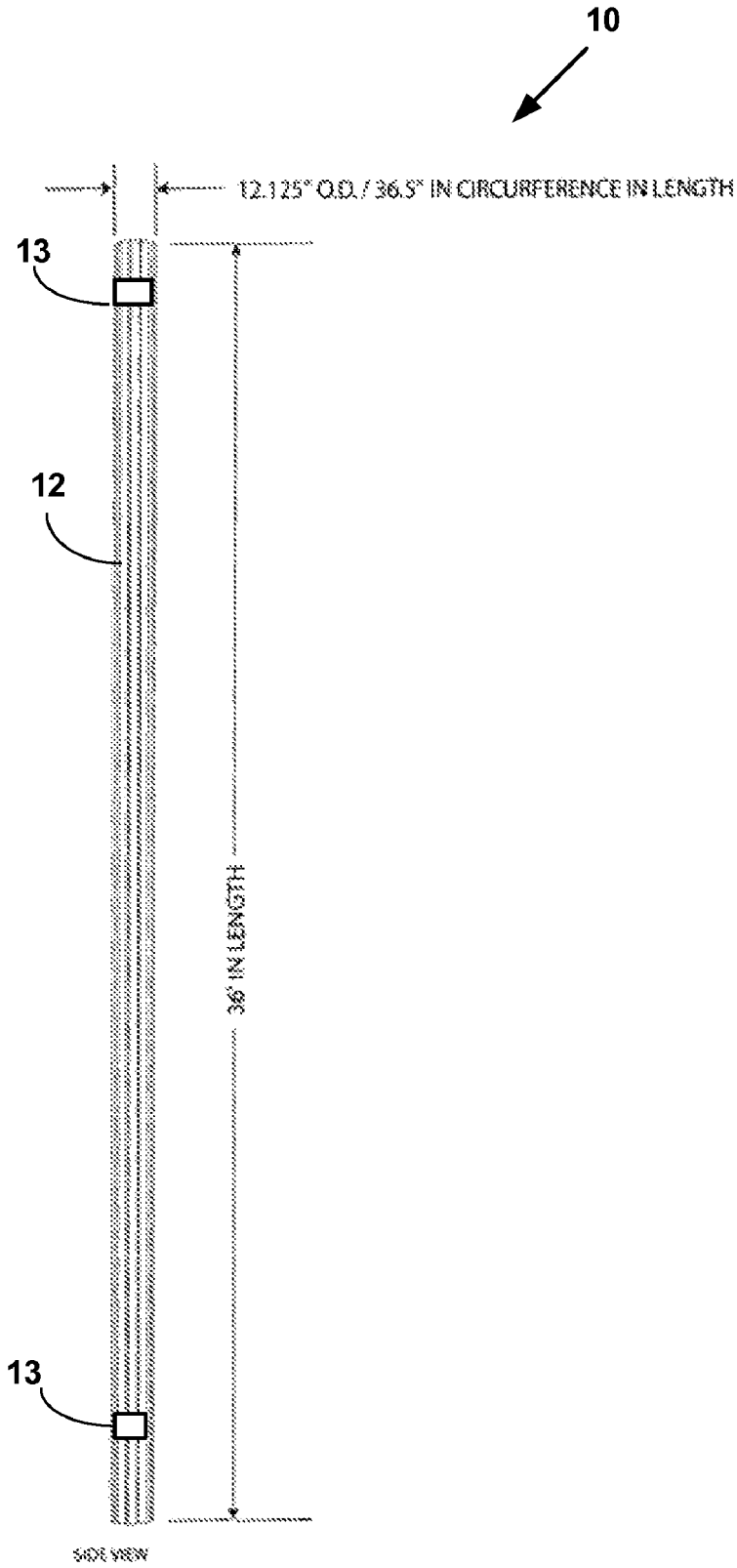
FIG. 1 is a block diagram illustrating a side view of an exemplary extruded hollow structure.

FIG. 1 is a block diagram illustrating a side view 10 of an exemplary extruded hollow structure 12.

In one embodiment, the extruded structure 12 comprises extruded plastic materials including, but not limited to, Polyvinyl Chloride (PVC), Acrylonitrile Butadiene Styrene (ABS), High Impact Polypropylene (HIP), Polypropylene, High-Density Polyethylene (HDPE), Polycarbonate, Polyethylene Terephthalate Glycol (PETG), Nylon, Fiber reinforced Polypropylene, Fiber Reinforced Plystyrene and other types of plastics. In another embodiment, the extruded structure 12 comprises composite materials. In another embodiment, the extruded structure 12 comprises recycled plastic materials.

The extruded structure 12 is extruded in plural different colors (e.g., red, green, yellow, blue, brown, etc.) and is aesthetically pleasing. The plural different colors may blend in with a natural environmental setting or a pre-determined design scheme. For example, a new subdivision may include only blue extruded utility poles.

In one exemplary embodiment, the extruded structure 12 is an extruded plastic utility pole 12 of extruded to a length of at least 36' in length. The exemplary extruded structure 12 has an outside at least 12.125" and a 36.5" circumference. However, the present invention is not limited to the dimensions described and other extruded utility poles 12 of other lengths and dimensions can also be used to practice the invention.

In one embodiment, the extruded structure 12 includes a pre-determined length (e.g., 8 feet, 16 feet, 24 feet, 36 feet, 40 feet, 65 feet etc.). However, the present invention is not limited to these lengths and other lengths can be used to practice the invention.

In one embodiment, a 36' length of the extruded structure 12 weighs about 100 pounds. It is estimated that a 36' length of the extruded structure 12 has a tensile strength of about 8,500 pounds per square inch (PSI).

It is estimated that an extruded structure 12 would have a lifetime of over 100 years and be safe to the environment, humans and animals. The extruded structure 12 is resistance to damage from the weather, animals, insects and is corrosion resistant.

Figure 2:
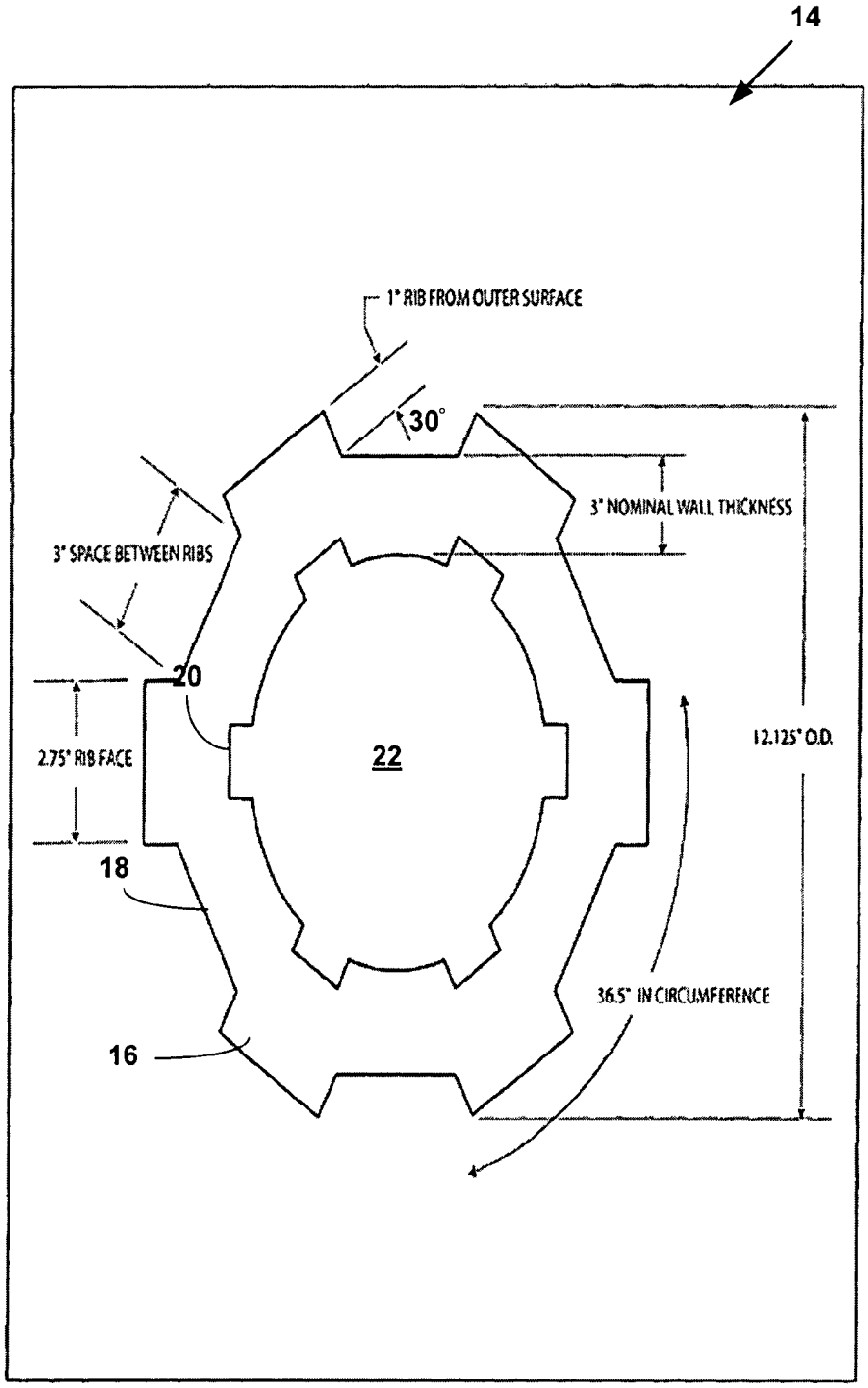
FIG. 2 is a block diagram illustrating a top view of an exemplary extruded hollow structure.

FIG. 2 is a block diagram illustrating a top view 14 of an exemplary extruded structure 12. In one exemplary embodiment, the exemplary extruded structure 12 includes plural ribbed faces 16. The plural rib faces 16 are connected with plural angular faces 18. An inner surface of the plural rib faces 16 includes plural intrusions 20. The plural intrusions 20 are in alignment with the plural ribbed faces 16.

In one embodiment the plural intrusions 20 are used a channel to hold plural different sets of wires such as communications wires or antenna wires.

Figure 2A:
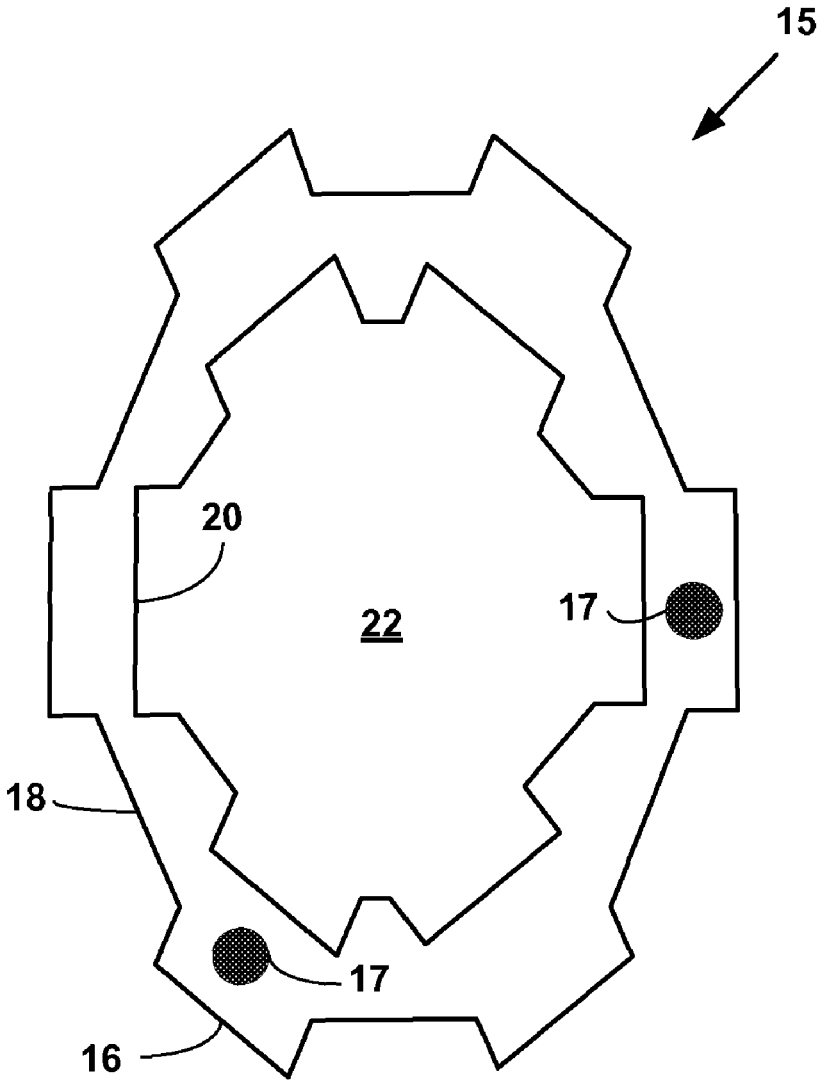
FIG. 2A is a block diagram illustrating top view of another exemplary extruded hollow structure including plural flat intrusions a same size as plural flat ribs.

FIG. 2A is a block diagram 15 illustrating top view of another exemplary extruded hollow structure including plural flat intrusions 20 the same size as the plural flat ribs 16.

FIG. 2 is illustrated with an exemplary embodiment. However, the present invention is not limited to such an embodiment and other embodiments can also embodiments can also be used to practice the invention.

In such an embodiment, exemplary extruded structure 12 includes plural flat rib faces 16. In one embodiment, the plural flat rib faces include a width of about 2.75". The plural flat rib faces 16 comprise a rib of about 1" from the outer surface of the extruded structure 12. The plural flat rib faces 16 are connected with plural angular faces 18. In one embodiment, the plural angular faces 18 include an angle of about 30 degrees and a flat surface of about 3" in width. The extruded utility pole includes a circumference of about 36.5" and an outside diameter of about 12.125". An inner surface of the plural flat rib faces 16 includes plural flat intrusions 20. The plural flat intrusions 20 can be used a channel to hold plural different sets of wires such as communications wires or antenna wires.

However, the present invention is not limited to the shapes and dimensions described and other extruded structures 12 of other shapes and dimensions can also be used to practice the invention.

In one embodiment, the extruded structure 12 includes one or more receptacles 13 (FIG. 1) are pre-determined heights in the plural flat rib faces 16. In such an embodiment, the one or more receptacles 13 are used for adding utility components such utility boxes, etc. The one or more receptacles 13 may include pre-determined features such as a screw pattern or other pattern for inserted a screw or other attachment means.

In another embodiment, the plural flat rib faces 16 include plastic, nylon, composite materials or other types of filaments to add additional strength to the extruded structure 12.

In another embodiment, the plural flat rib faces 16 include integral copper wires 17 (two of which are illustrated in FIG. 2A) that allow the extruded structure 12 to be used an antenna for wireless or other types of communications. In another embodiment, the integral copper wires are embedded into other surfaces of extruded structure 12.

FIG. 2 illustrates an extruded structure 12 with a hollow core 22. In such an embodiment, communications wires (e.g., fiber optic, copper, coaxial cable, etc.) or antenna wires can be run through the hollow core (as well as the plural flat intrusions 20) to connect to other communications wires buried underground in dirt or sub-terrain pipes or tunnels. This avoids connecting unsightly communications wires between two or more extruded structure 12 and protects the communications wires or antenna wires from damage by the weather and animals.

FIG. 2 illustrates an extruded structure 12 with a hollow core. However, the present invention is not limited to this embodiment and the extruded structure 12 can be extruded as solid piece of material. In such an embodiment, the weight of the extruded structure 12 would be more than 100 pounds and have a different tensile strength.

In one embodiment, the extruded structure 12 includes a fiber or webbing re-enforced cylindrical structure comprising a utility pole, a lighting pole, a structural support, an architectural design element (interior or exterior), a marine dock element or a fencing element.

In one embodiment, the extruded structure 12 includes additional fiberglass, plastic, ester, polyester, nylon, composite materials or other types of filaments or webbing to add additional strength to the extruded structure 12. The filaments or webbing are applied internally or externally to the extruded structure 12.

The structure of the external and internal surfaces in an alternating and repeating pattern of the extruded structure 12 provides additional tensile strength to the structure. In addition, the angular lines of the structure are aesthetically pleasing.

In addition, the shape of the extruded structure 12 provides an optimal resistance, or near optimal resistance to wind shear forces.

Pultruded Utility Structures

As is known in the art, "pultrusion" is a manufacturing process for producing continuous lengths of materials. Pultrusion raw materials include a liquid resin mixture (e.g., containing resin, fillers and specialized additives) and reinforcing fibers (e.g., fiberglass, composite materials, etc.). The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture in the resin impregnator and pulled through the die, the gelation (or hardening) of the resin is initiated by the heat from the die and a rigid, cured profile is formed that corresponds to the shape of the die.

There are also protruded laminates. Most pultruded laminates are formed using rovings aligned down the major axis of the part. Various continuous strand mats, fabrics (e.g., braided, woven and knitted), and texturized or bulked rovings are used to obtain strength in the cross axis or transverse direction.

The pultriusion process is normally continuous and highly automated. Reinforcement materials, such as roving, mat or fabrics, are positioned in a specific location using preforming shapers or guides to form a pultruson. The reinforcements are drawn through a resin bath where the material is thoroughly coated or impregnated with a liquid thermosetting resin. The resin-saturated reinforcements enter a heated metal pultrusion die. The dimensions and shape of the die define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

In one embodiment the pultrusion resins include bisphenol-a epichlorohydrin-based vinyl esters. In another embodiment, the resins include polyesters including isophthalic, orthophthalic, propylene-maleate, fire resistant, and high cross-link density. However, the present invention is not limited to these resins and other resins can be used to practice the invention.

In one embodiment, the pultrusions include re-enforcing fibers comprising, fiberglass fibers, composite fibers, etc. However, the present invention is not limited to these resins and other resins can be used to practice the invention.

One resin used in fiberglass pultrusions is a thermoset resin. The resin used in Polyvinyl Chloride (PVC) pultrusions are typical thermoplastic resins. In the pultrusion process, under heat and pressure, the thermoset resins and re-enforcing fibers form a new inert material that is impervious to temperature. Pultruded fiberglass physical properties do not change through the full temperature cycle up to temperatures of about 200 degrees Fahrenheit (° F.). In direct contrast, PVC resins typically become unstable at temperatures greater than 155° F.

Pultrusions, include but are not limited to, structures comprising: (1) HIGH STRENGTH—typically stronger than structural steel on a pound-for-pound basis; (2) LIGHT-WEIGHT—Pultrusions are 20-25% the weight of steel and 70% the weight of aluminum. Pultruded products are easily transported, handled and lifted into place; (3) CORROSION/ROT RESISTANT—Pultruded products will not rot and are impervious to a broad range of corrosive elements; (4) NON-CONDUCTIVE—fiberglass reinforced pultrusions have low thermal conductivity and are electrically non-conductive; (5) ELECTRO-MAGNETIC TRANSPARENT—Pultruded products are transparent to radio waves, microwaves and other electromagnetic frequencies; (6) DIMENSIONAL STABILE—The coefficient of thermal expansion of pultruded products is slightly less than steel and significantly less than aluminum; (7) LOW TEMPERATURE CAPABLE—FiberGlass fiber reinforced pultrusions exhibit excellent mechanical properties at very low temperatures, even −70° F. Tensile strength and impact strengths are greater at −70° F. than at +80° F.; and (8) AESTHETICLY PLEASING—Pultruded profiles are pigmented throughout the thickness of the part and can be made to virtually any desired custom color. Special surfacing veils are also available to create special surface appearances such as wood grain, marble, granite, etc.

In another embodiment the extruded utility structures described above and illustrated in FIGS. 1 and 2 are pulturded. In such embodiments a pultrusion die is created based on the desired design shape illustrated FIG. 2.

Figure 3:
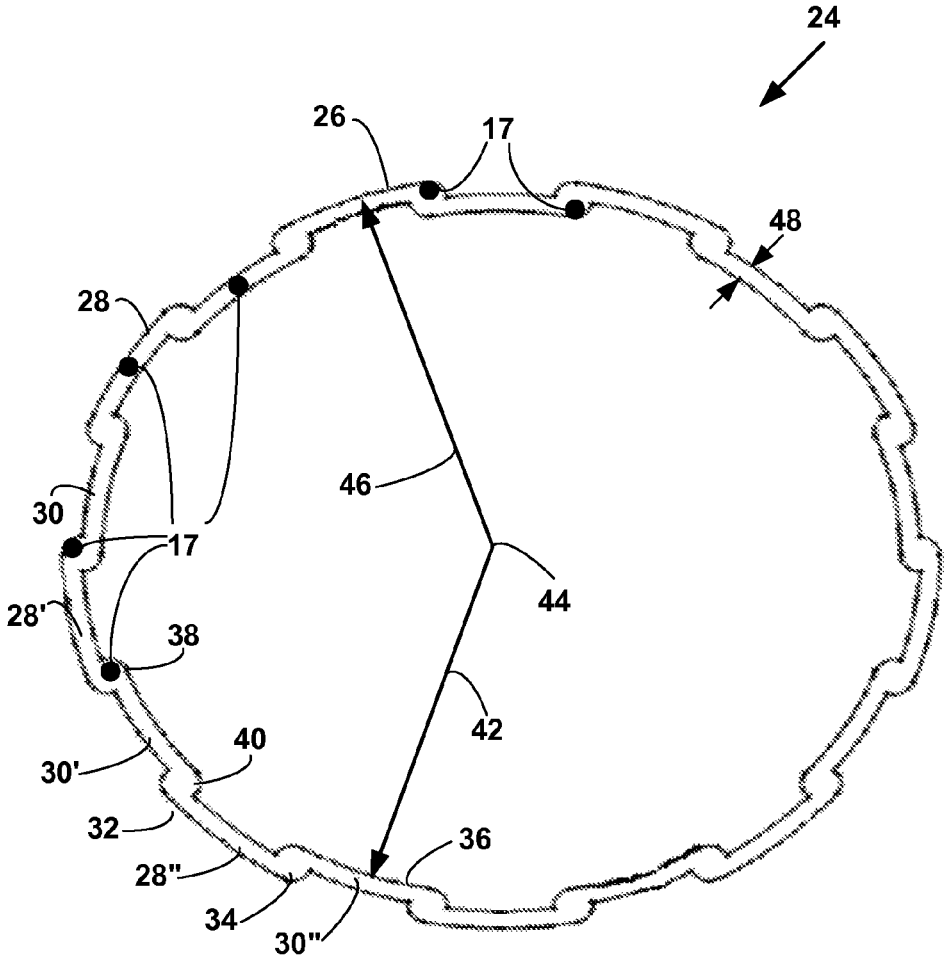
FIG. 3 illustrates a cross-section of a pultruded hollow structure.

FIG. 3 illustrates a cross-section of a pultruded hollow cylindrical structure 24. In one embodiment the pultruded hollow cylindrical structure includes an external surface 26 including plural protruding components 28 connected to plural intruding components 30. A protruding component 28' includes two curved components 32, 34 for connecting the protruding component 28' to two other intruding components 30' and 30".

The pultruded hollow cylindrical structure 24 further includes an internal surface 36 including plural intruding components 30 connected to the plural protruding components 28. An intruding component 30' includes two curved components 38, 40, to connect the intruding component 30' to two other protruding components 28' and 28"

The curved components 32, 34, 38, 40 include a pre-determined radius with two outer radius portions on an protruding component 28' and two inner radius portions on an intruding component 30'.

The pultruded hollow cylindrical structure includes a pre-determined inner radius 42 from a center point 44 to an inner portion of the internal surface 36 and includes a pre-determined outer radius 46 from the center point 44 to an outer portion of the external surface 26. The difference between the pre-determined inner radius and pre-determined outer radius determines a thickness 48 of the pultruded hollow cylindrical structure 24.

The pultruded hollow cylindrical structure 24 includes a pre-determined length and a pre-determined color.

In one embodiment, a pultrusion die is created with the design shape and dimensions illustrated in FIG. 3. However, the present invention is not limited to such an embodiment and other embodiments with other dimensions can be used to practice the invention.

The structure of the external and internal surfaces in an alternating and repeating pattern of the pultruded hollow cylindrical structure 24, 50 provide additional tensile strength to the structure. In addition, the curved lines of the pultruded hollow cylindrical structure 24, 50 are aesthetically pleasing. In addition, the shape of the pultruded hollow cylindrical structure 24, 50 provide an optimal resistance, or near optimal resistance to wind shear forces.

FIG. 3 illustrates a pultruded hollow cylindrical structure 24 with a hollow core. However, the present invention is not limited to this embodiment and the pultruded structure 24 can be pultruded as solid piece of material by changing the plutrusion die.

Figure 4:
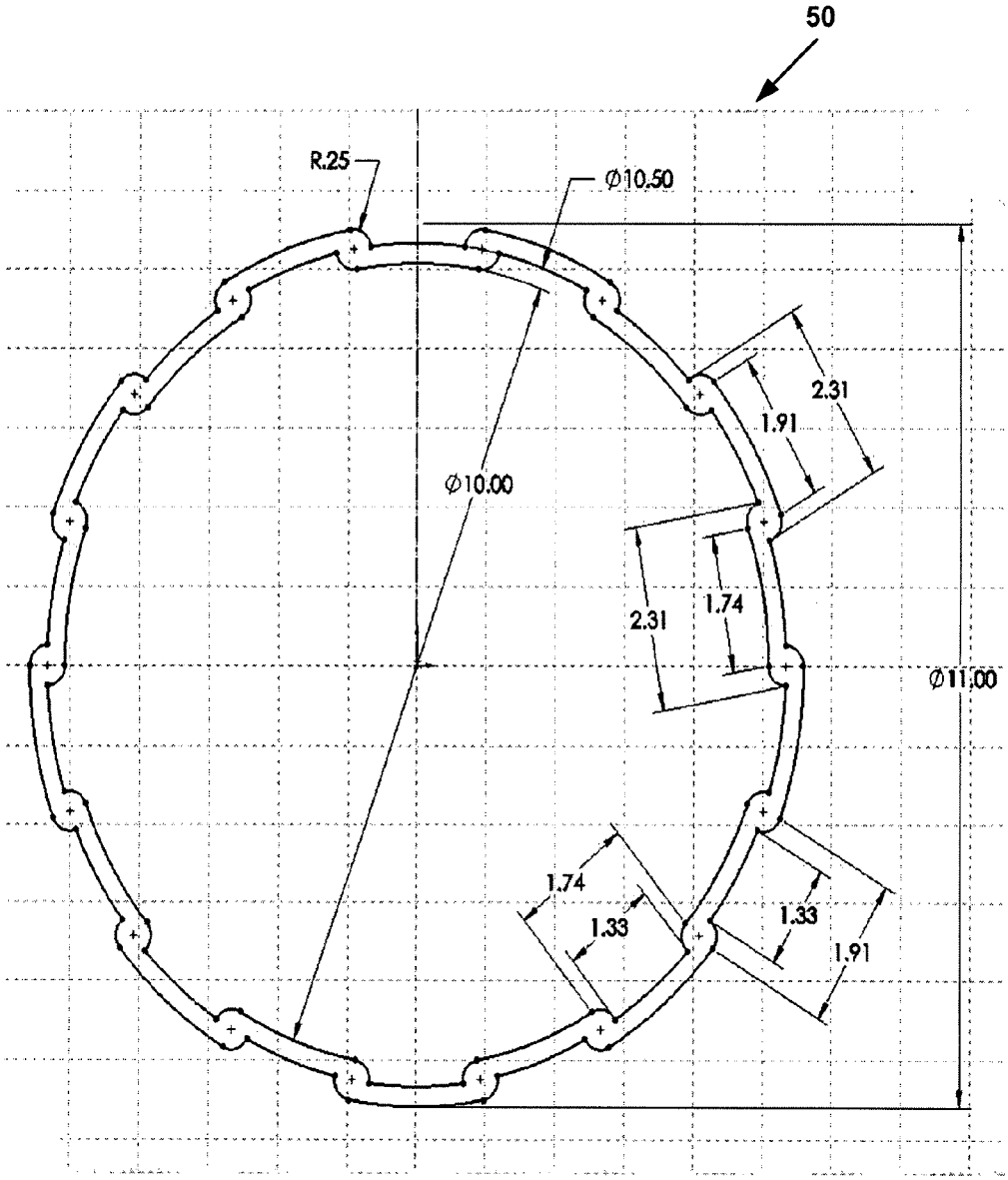
FIG. 4 illustrates a cross-section of an exemplary pultruded hollow structure.

FIG. 4 illustrates a cross-section of an exemplary pultruded hollow structure 50.

Figure 5:
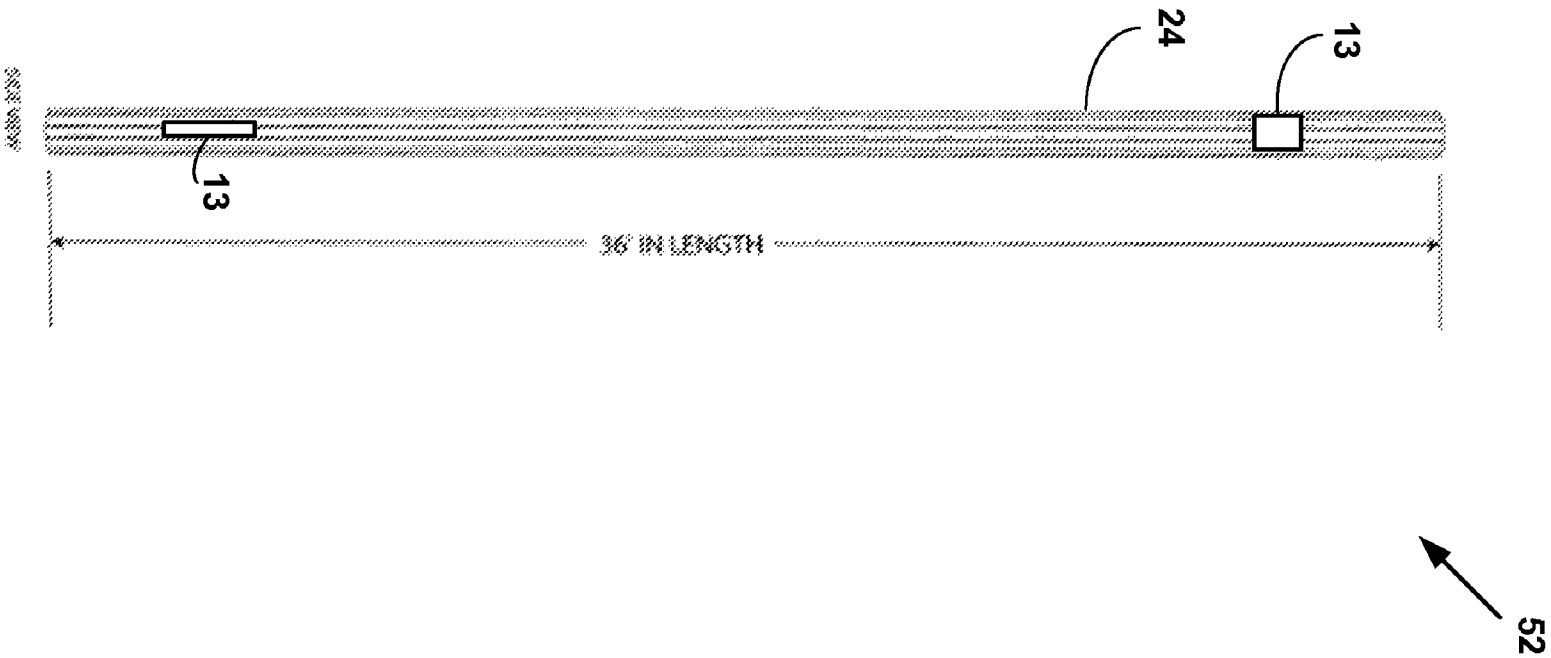
FIG. 5 illustrates a block diagram of a side view of an exemplary pultruded hollow structure.

FIG. 5 illustrates a block diagram of a side view of an exemplary pultruded hollow structure 52.

The pultruded hollow cylindrical structure 50 is illustrated with an exemplary embodiment as is illustrated in FIG. 4. However, the present invention is not limited to this embodiment and other embodiments can also be used to practice the invention.

In one embodiment, the pultruded hollow cylindrical structure 24 includes a cylindrical structure comprising a utility pole, a lighting pole, a structural support, an architectural design element (interior or exterior), a marine dock element or a fencing element, etc.

The pultruded hollow cylindrical structures 24, 50 include a pre-determined length (e.g., 8 feet, 16 feet, 24 feet, 36 feet, 40 feet, 65 feet etc.). However, the present invention is not limited to these lengths and other lengths can be used to practice the invention.

The pultruded hollow cylindrical structures 24, 50 includes plural different colors (e.g., red, green, yellow, blue, brown, etc.) and is aesthetically pleasing. The plural different colors may blend in with a natural environmental setting or a pre-determined design scheme. For example, a new subdivision may include only blue utility poles, while a boat dock may include only high visibility orange decking comprising the pultruded hollow cylindrical structures 24, 50. However, the present invention is not limited to these colors and other colors can be used to practice the invention.

The pultruded hollow cylindrical structure 24 includes a repeating pattern of alternating protruding and intruding components.

In one embodiment, the pultruded hollow cylindrical structure 24 includes one or more receptacles 13 (FIG. 5) at pre-determined heights. In such an embodiment, the one or more receptacles 13 are used for adding utility components such utility boxes, etc. The one or more receptacles 13 may include pre-determined features such as a screw pattern or other pattern for inserted a screw or other attachment means.

In one embodiment, the plural protruding components and plural intruding components include additional fiberglass, plastic, ester, polyester, nylon, composite materials or other types of filaments or webbing to add additional strength to the pultruded hollow cylindrical structure 24. The filaments or webbing are applied internally or externally to the pultruded hollow cylindrical structure 24.

In another embodiment, the pultruded hollow cylindrical structure 24 includes integral copper wires 17 in one or more surfaces (plural ones of which are illustrated in FIG. 3) that allow the structure to be used an antenna for wireless or other types of communications.

Various exemplary and specific measurements are described herein. However, the present invention is not limited to these exemplary and specific measurements. In addition, the extruded and pultruded structures described herein can be made with specific measurements for actual products such as 2×4's, structural beams, fencing, wooden telephone poles, etc. In such embodiments, the extruded or pultruded structures may be thicker then necessary and may include the shapes of the actual products instead of the shapes describe herein.

It should be understood that the processes, methods and system described herein are not related or limited to any particular type of component unless indicated otherwise. Various combinations of general purpose, specialized or equivalent components combinations thereof may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer or equivalent elements may be used in the block diagrams.

The claims should not be read as limited to the elements described unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A hollow cylindrical structure, comprising:

a repeating pattern of a plurality of alternating protruding components and intruding components forming an external surface and internal surface of the hollow cylindrical structure, wherein the repeating pattern of the plurality of alternating protruding components and intruding components of the hollow cylindrical structure provide tensile strength to the hollow cylindrical structure and wherein a shape created by the repeating pattern of the plurality of alternating protruding components and intruding components provides an optimal wind shear resistance for the hollow cylindrical structure;

the external surface including the plurality of protruding components integrally connected to the plurality of intruding components with a plurality of curved connection components, wherein an individual protruding component includes two individual curved connection components connecting the individual protruding component to two individual intruding components and wherein the two individual curved connection components form an integral portion of both the individual protruding component and an integral portion of the two individual intruding components;

the internal surface including the plurality of intruding components integrally connected to the plurality of protruding components with the plurality of curved connection components, wherein an individual intruding component includes two other individual curved connection components for connecting the individual intruding component to two individual protruding components and wherein the two other individual curved connection components form another integral portion of both the individual intruding component and another integral portion of the two other individual protruding components;

the plurality of curved connection components each including a pre-determined curved connection component radius with two separate curved connection component outer radius portions forming two separate integral outer portions of an individual protruding component and two separate curved connection component inner radius portions forming two separate integral inner portions of an individual intruding component;

a pre-determined hollow cylindrical structure inner radius from a center point to an inner portion of the internal surface; and a pre-determined hollow cylindrical structure outer radius from the center point to an outer portion the external surface, wherein the difference between the pre-determined hollow cylindrical structure inner radius and pre-determined hollow cylindrical structure outer radius determines a thickness of the hollow cylindrical structure, wherein the hollow cylindrical structure is a laminate pultruded hollow cylindrical structure created from a liquid resin mixture, reinforcing fibers and rovings aligned down a major axis of the hollow cylindrical structure, and wherein the hollow cylindrical structure includes a pre-determined length.

2. The hollow cylindrical structure of claim 1 wherein the hollow cylindrical structure includes the laminate pultruded hollow cylindrical structure created from the liquid resin mixture, reinforcing fibers and rovings aligned down the major axis of the hollow cylindrical structure and pultruded from a heated metal die.

3. The hollow cylindrical structure of claim 1 wherein the hollow cylindrical structure is pultruded into a utility pole, a lighting pole, a structural support, an architectural design element, a marine dock element or a fencing element.

4. The hollow cylindrical structure of claim 1 wherein the hollow cylindrical structure is an extruded hollow cylindrical structure comprising a plastic or composite material.

5. The hollow cylindrical structure of claim 1 wherein the hollow cylindrical structure is a pre-determined color.

6. The hollow cylindrical structure of claim 1 wherein the hollow cylindrical structure includes one or more hollow receptacles at pre-determined heights for adding utility components including utility boxes.

7. The hollow cylindrical structure of claim 1 wherein the hollow cylindrical structure includes integral copper wires providing an antenna for wireless or other types of communications.

8. The hollow cylindrical structure of claim 1 wherein the hollow cylindrical structure is created with a liquid resin mixture and reinforcing fibers.

9. The hollow cylindrical structure of claim 8 wherein the liquid resin mixture includes abisphenol-a epichlorohydrin-based vinyl ester resins or polyester resins including isophthalic, orthophthalic, or propylene-maleate resins.

10. The hollow cylindrical structure of claim 1 further comprising:

a plurality of different sets of wires, wherein the plurality of intruding components provide interior channels to hold the plurality of different sets of wires including communications wires or antenna wires in an interior of the hollow cylindrical structure.

11. A pultruded hollow utility pole, comprising:

a repeating pattern of a plurality of alternating protruding components and intruding components forming an external surface and internal surface of the pultruded hollow utility pole, wherein the repeating pattern of the plurality of alternating protruding components and intruding components of the pultruded hollow utility pole provide tensile strength to the pultruded hollow utility pole and wherein a shape created by the repeating pattern of the plurality of alternating protruding components and intruding components provides an optimal wind shear resistance for pultruded hollow utility pole;

the external surface including the plurality of protruding components integrally connected to the plurality of intruding components with a plurality of curved connection components, wherein an individual protruding component includes two individual curved connection components connecting the individual protruding component to two individual intruding components and wherein the two individual curved connection components form an integral portion of both the individual protruding component and an integral portion of the two individual intruding components;

the internal surface including the plurality of intruding components integrally connected to the plurality of protruding components with the plurality of curved connection components, wherein an individual intruding component includes two other individual curved connection components for connecting the individual intruding component to two individual protruding components and wherein the two other individual curved connection components form another integral portion of both the individual intruding component and another integral portion of the two other individual protruding components;

the plurality of curved connection components each including a pre-determined curved connection component radius with two separate curved connection component outer radius portions forming two separate integral outer portions of an individual protruding component and two separate curved connection component inner radius portions forming two separate integral inner portions of an individual intruding component;

a pre-determined pultruded hollow utility pole inner radius from a center point to an inner portion of the internal surface; and a pre-determined pultruded hollow utility pole outer radius from the center point to an outer portion the external surface, wherein the difference between the pre-determined pultruded hollow utility pole inner radius and pre-determined pultruded hollow utility pole outer radius determines a thickness of the pultruded hollow utility pole;

wherein the pultruded hollow utility pole includes a pre-determined length, wherein the pultruded hollow utility pole is a laminate pultruded hollow cylindrical structure created from a liquid resin mixture, reinforcing fibers and rovings aligned down a major axis of the hollow cylindrical structure, and wherein the pultruded hollow utility pole is created with a liquid resin mixture and reinforcing fibers pultruded from a heated die.

12. The pultruded hollow utility pole of claim 11 wherein:

the hollow utility pole includes the laminate pultruded hollow cylindrical structure created from the liquid resin mixture, reinforcing fibers and rovings aligned down the major axis of the hollow cylindrical structure and pultruded from a heated metal die.

13. The pultruded hollow utility pole of claim 12 wherein the plurality of intruding components provide channels to hold a plurality of different sets of wires including communications wires or antenna wires.

14. The pultruded hollow utility pole of claim 12 wherein the pultruded hollow utility pole includes a pre-determined color.

15. The pultruded hollow utility pole of claim 12 wherein the hollow cylindrical structure includes one or more hollow receptacles at pre-determined heights for adding utility components including utility boxes.

16. The pultruded hollow utility pole of claim 12 wherein the hollow cylindrical structure includes integral copper wires in the plurality of external surfaces or internal surfaces that allow the hollow cylindrical structure to be used an antenna for wireless or other types of communications.

17. The pultruded hollow utility pole of claim 12 wherein the hollow cylindrical structure comprises a plastic material, a composite material or a material including a resin and reinforcing fibers.

* * * * *